US006327749B1

(12) United States Patent
Antinone

(10) Patent No.: US 6,327,749 B1
(45) Date of Patent: Dec. 11, 2001

(54) MONEY CLIP

(76) Inventor: Lawrence Ernest Antinone, 16979 Boulder Oaks Dr., Ramona, CA (US) 92065

( * ) Notice: Subject to any disclaimer, the term of this patent is extended or adjusted under 35 U.S.C. 154(b) by 0 days.

(21) Appl. No.: 09/574,895

(22) Filed: May 19, 2000

(51) Int. Cl.[7] ..... B42F 1/02

(52) U.S. Cl. ..... 24/67 R; 24/67.9; 24/67.5; 24/67.3

(58) Field of Search ..... 24/67 R, 67.3, 24/67.5, 67.9, 327, 67 CF, 3.12, 3.11, DIG. 8, DIG. 9, DIG. 10, 565; 281/45; 402/60, 69

(56) References Cited

U.S. PATENT DOCUMENTS

| | | | | |
|---|---|---|---|---|
| D. 283,844 | | 5/1986 | Saad et al. . | |
| D. 372,498 | | 8/1996 | Sato . | |
| 1,150,073 | * | 8/1915 | Spengler | 24/565 |
| 4,332,060 | * | 6/1982 | Sato | 24/67.9 |
| 4,402,530 | * | 9/1983 | Daguerre | 281/45 |
| 4,532,680 | | 8/1985 | Hashimoto . | |
| 4,675,953 | | 6/1987 | Higgs . | |
| 4,761,862 | | 8/1988 | Hiromori . | |
| 4,802,263 | | 2/1989 | Lorber . | |
| 5,103,884 | | 4/1992 | Roman . | |
| 5,249,336 | | 10/1993 | Miller . | |
| 5,249,437 | | 10/1993 | Cole, Jr. . | |
| 5,653,276 | | 8/1997 | Niernberger . | |
| 5,870,802 | * | 2/1999 | Goldman | 24/67.9 |

OTHER PUBLICATIONS

A page from an on–line catalog titled "United States Ski Team" at http:store.yahoo.com/ . . . Feb. 23, 2000.

A page from an on–line catalog titled "Deep Sea Leather and Gifts" at htt;:store.yahoo.com/ . . . May 15, 2000.

* cited by examiner

*Primary Examiner*—Robert J. Sandy
(74) *Attorney, Agent, or Firm*—John V. Stewart

(57) ABSTRACT

An attractive convenient money clip made by attaching a folding cover to a conventional paper binder clip of the type having a spring steel clamp and two pivoting arms made of wire loops that fold back against the clamp for opening the clamp. This type of binder clip provides both strong clamping force and easy opening with one hand. It holds paper money, business cards, and a credit card safely and securely. The cover presents a professional appearance and a front and back external surface for logos. By using a conventional binder clip as the basis for this product, manufacturing cost is low, since only the cover is custom made.

5 Claims, 3 Drawing Sheets

MONEY CLIP

BACKGROUND OF THE INVENTION

1. Field of the Invention

This invention relates to clips for holding a bundle of paper currency.

2. Description of Prior Art

Products for carrying personal money include wallets, purses, bags, and clips. These are often designed to hold paper currency in an organized folded condition, with quick access. It addition, they may hold credit cards, business cards, and sometimes coins. Some people prefer money clips for holding a small amount of paper money in a clothes pocket, since other money holders, including wallets, bulge the pocket. A money clip should clamp the bills tightly enough to hold them securely, yet open easily for insertion and removal of the bills.

Prior money clips are designed using plain spring clamps, torsion springs, or other springs and clamps. These include simple spring clips as exemplified in U.S. design Pat. No. 283,844 (Sand et al., 1986). However, such simple clips must be pried open with the fingers using both hands, and held open awkwardly for insertion of bills, requiring dexterity. They are not highly secure, since the clamping force must be light in order to make opening practical.

U.S. Pat. No. 5,249,437 (Cole Jr., 1993) has a special locking arm 26 and a pressure arm 36 that provides a stable closed pressure against a bundle of bills. This should provide improved holding power and convenience of operation over simple spring clips. However, it has a pressure foot 36 that slides across the bills as it clamps them, which may cause damage to the bills or to a credit card clamped within the bills. Also, this device is completely custom made, requiring special tooling for manufacture.

Other prior money clips have disadvantages similar to one or both of the above two examples. Most of them require the fingers of two hands to open the jaws; many of them cannot provide strong clamping force because they would be too hard to open; most of them do not have a soft, attractive cover with a large front and back surface for logos or other decoration, and most of them require custom clamping hardware. All of these disadvantages are solved in the present invention

SUMMARY OF THE INVENTION

The objectives of the present invention are provision of an attractive, convenient, compact, soft, and secure money clip that safely holds paper money, business cards, and a credit card, is easy to open yet clamps tightly, and is inexpensive to manufacture.

These objectives are achieved by providing an attractive cover on a conventional paper binder clip of the type having a spring steel clamp and two pivoting arms made of wire loops that fold back against the clamp for opening the clamp. This type of binder clip is ideal for a money clip, providing both strong clamping force and easy opening. It holds paper money, business cards, and a credit card safely and securely. The cover presents a professional appearance for the clip, and a two external surfaces for logos. By using a conventional binder clip as the basis for the money clip, manufacturing cost is low, since only the cover is custom made.

REFERENCE NUMBERS

Figure 1:
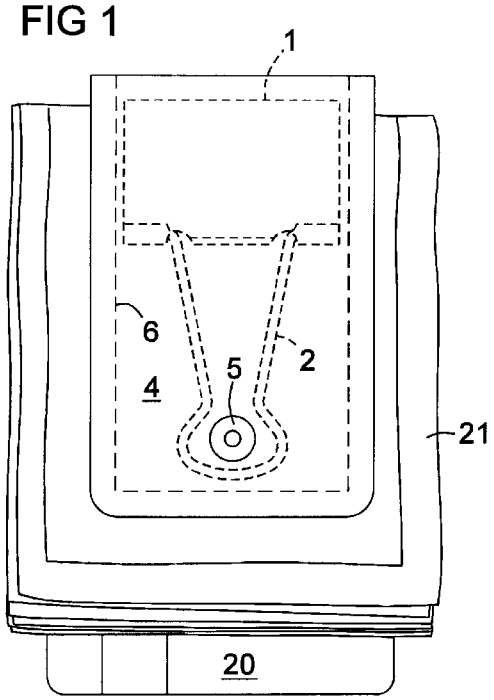
FIG. 1 is a front view of the invention in use, with a hidden line showing of a conventional paper binder clip that provides the clamping mechanism.

1. Spring steel clamp or jaw of binder clip
1*a*. Base plate portion of clamp
1*b*. Side plate portion of clamp
2. Pivoting arm of binder clip
3. Inner layer of cover
4. Outer layer of cover
5. Rivet
6. Seam
7. Rivet hole
8. Slit
9. Logo
11. Manual opening force
12. Insertion of bills and credit card into clip
20. Credit card
21. Paper currency

DETAILED DESCRIPTION

Figure 2:
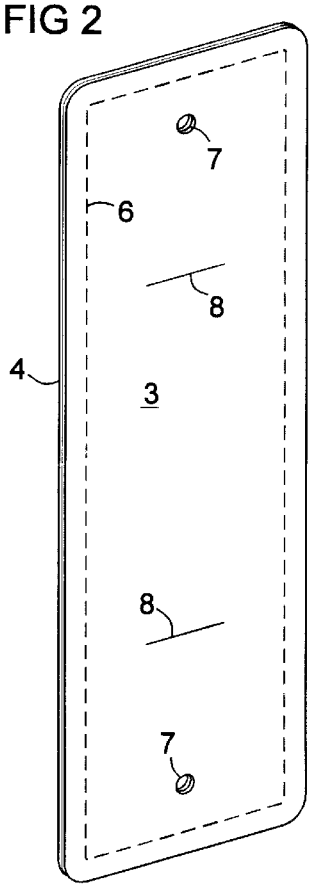
FIG. 2 is a perspective view of the cover that provides a professional appearance for the money clip.
Figure 3:
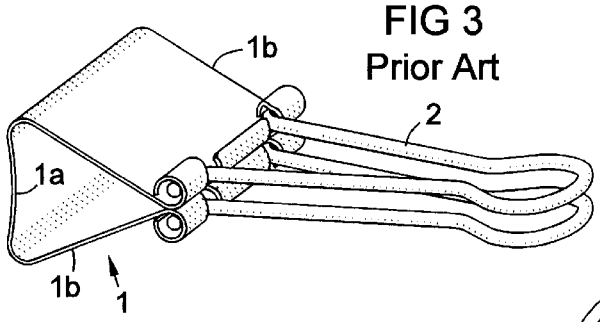
FIG 3 Prior Art
FIG. 3 is a perspective view of a conventional paper binder clip of the type used in this invention.

The invention is a paper currency clip that is made from a conventional paper binder clip of the type shown in FIG. 3 combined with a cover as shown in FIG. 2. A conventional binder clip of FIG. 3 is convenient and efficient for holding bundles of paper securely as is well known. It has a spring steel clamp 1, and pivoting arms 2 made of loops of wire that rotate back against the clamp and are manually squeezed together to open the clamp. The pivoting arms provide leverage, making a strong clamp practical to open. They also provide a convenient grip for holding the clamp open with one hand to receive a bundle of papers held in the other hand. The levers can then be rotated forward to lie flat against the papers, eliminated their outward protrusion.

Figure 4:
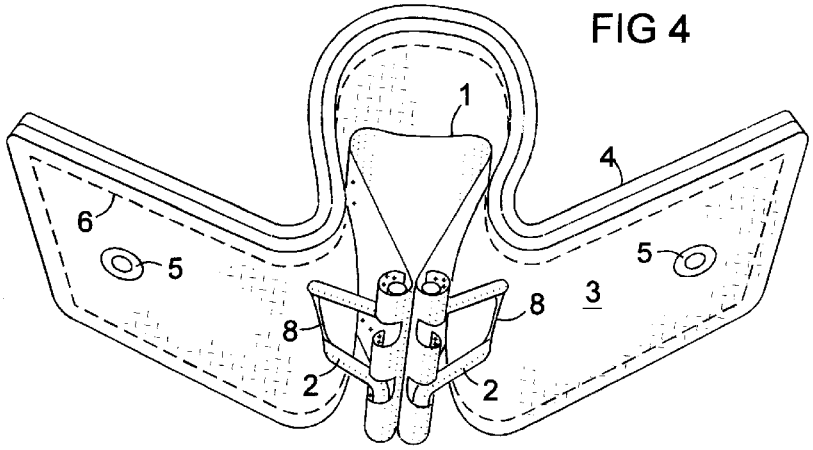
FIG. 4 is a perspective view of the assembly of the parts shown in FIGS. 2 and 3 to form the invention.
Figure 5:
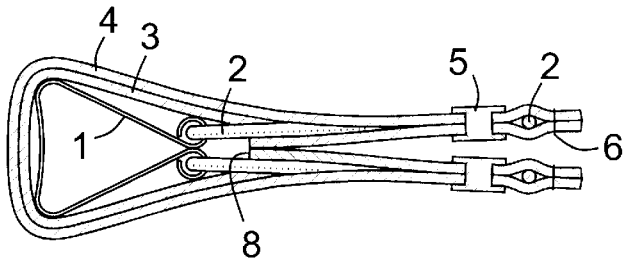
FIG. 5 is a side sectional view of the invention.

This type of binder clip is ideal for holding bundles of paper, including paper currency. However, it has a plain utilitarian appearance, rather than a professional stylish appearance. The present invention provides a cover made of an inner layer 3 and an outer layer 4, sewn together around the periphery by stitching 6. The inner layer has two slits 8 that accept the arms 2 of the binder clip. The arms 2 are slipped into these slits as shown in FIG. 4, and are retained in the cover by rivets 5 that connect the outer and inner layers of the cover together within the loop of the arms.

Figure 6:
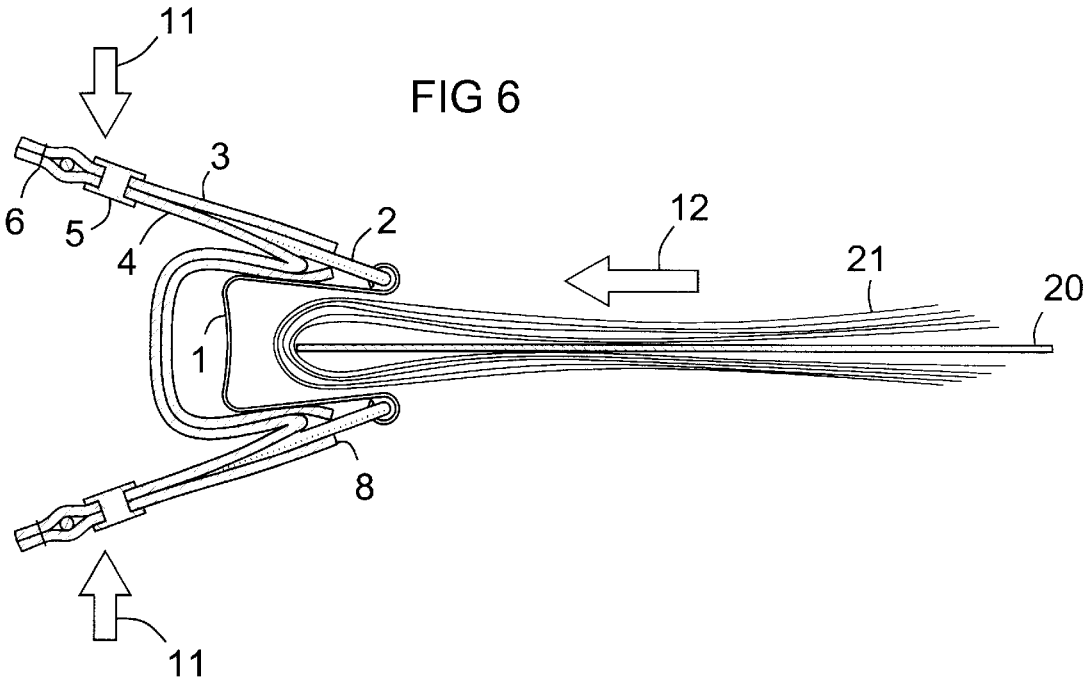
FIG. 6 is a side sectional view of the invention being held in the open position and receiving a bundle of paper currency and a credit card.

This cover allows normal operation of the binder clip, including opening of the clamp as shown in FIG. 6 for receiving bundles of paper currency. The arms can also be pivoted forward to lie flat against the currency as in FIG. 7. The resulting money clip is attractive, convenient, and secure. In addition, manufacturing is very simple, since the only custom part is the cover, which requires only cutting and sewing. Assembly only requires insertion of the arms in the slits, and riveting. This manufacturing process can be mechanized, or it can be done manually, allowing the lowest cost mode of production to be selected.

Figure 7:
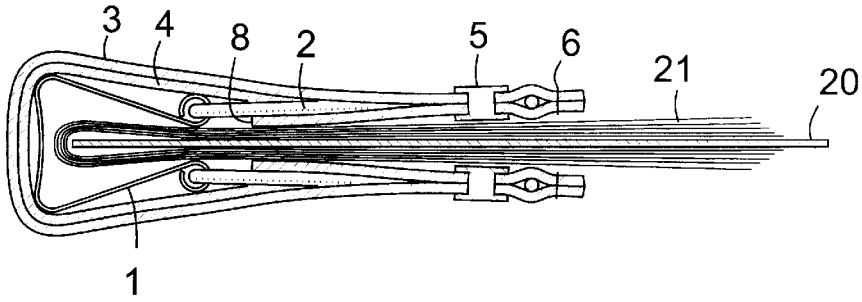
FIG. 7 is a side sectional view of the invention holding a bundle of paper currency and a credit card.
Figure 8:
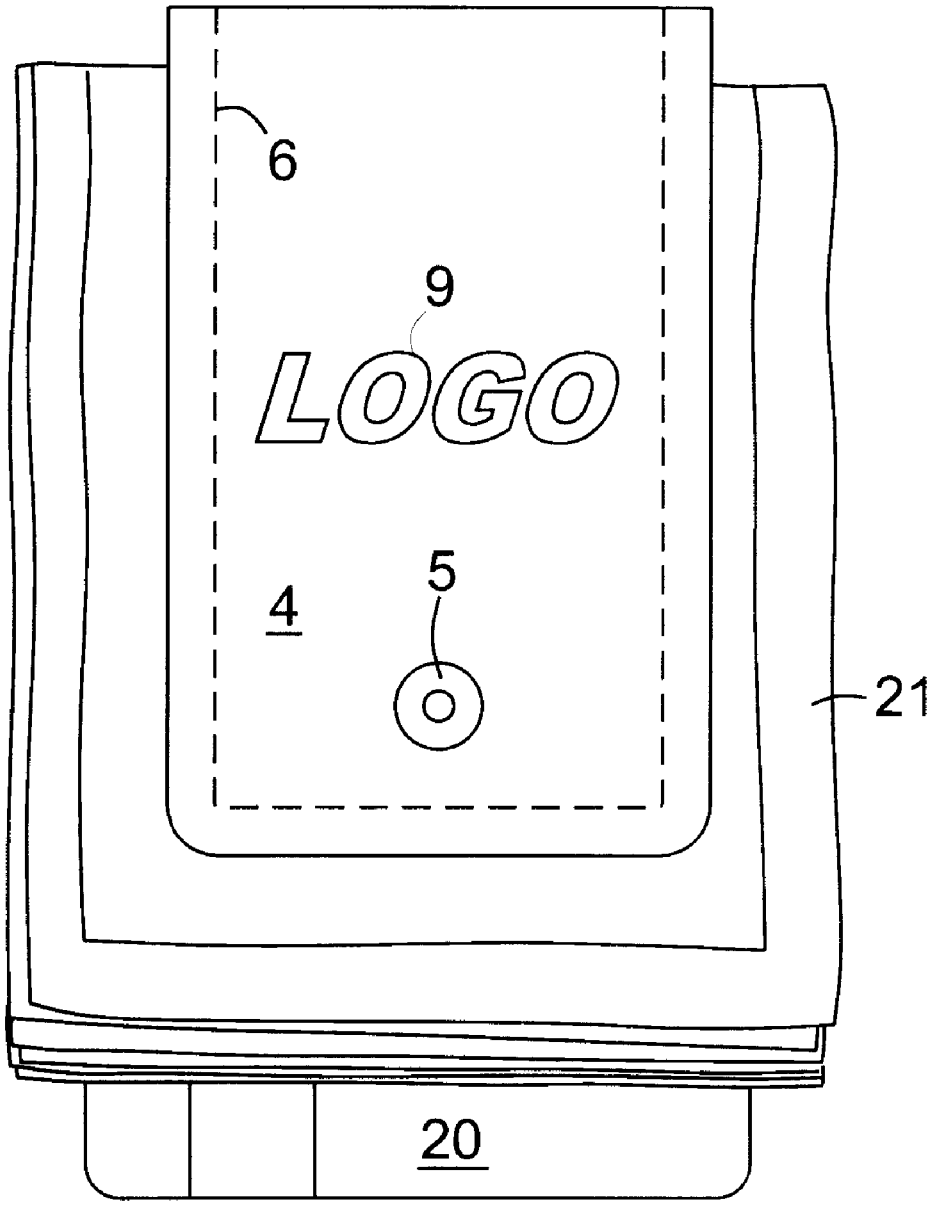
FIG. 8 is a front external view of the money clip with a logo.

The final product, as shown in FIG. 8 lends itself to surface ornamentation, including business logos or personalization. In operation, a user pivots the arms back as in FIG. 6 to insert or remove paper currency 21. A credit card 20 can safely be held within the folded currency as shown. The arms are pivoted forward against the currency as shown in FIGS. 7 and 8 for carrying in a user's pocket. This provides a more compact money holder than a wallet.

The cover material is preferably leather, but it can be any flexible flat material, including plastic. Of course, variations in construction are possible. A full inner layer 3 of the cover as shown is preferred. Optionally only a pocket for each arm is needed. The rivet can be replaced with a snap, button, stitch, or a spot weld in plastic. The seam 6 is preferably stitching, but could be adhesive, a row of plastic rivets, or any other conventional seam type. For example, the cover could be made of plastic, the seam could be a heat seal, and the rivet could be a spot weld.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A money clip for holding paper currency, comprising:

a binder clip of a type with a spring clamp jaw and first and second arms pivotally attached to the clamp jaw for opening the jaw with the fingers of one hand;

a cover made of a flat flexible material;

the cover folded approximately in half, resulting in an outer and an inner surface;

two pockets on the inner surface of the cover retaining the two arms respectively; and the cover folded around the clamp, covering the clamp and arms, and retaining the arms within the pockets.

2. The clip of claim 1, wherein the cover comprises two superimposed layers of the flexible material connected together along a seam around the periphery thereof, the inner layer having two openings for receiving the two arms, the space between the two layers forming the pockets for holding the two arms.

3. The clip of claim 2, wherein each arm is made of a wire loop, and further comprising a connection between the two layers of material at a point within the loop of each arm to retain the arms in the pockets.

4. A money clip for holding paper currency, comprising:

a binder clip having an elastic clamp portion comprising a base plate with first and second sides, first and second side plates each having a first end attached to the respective side of the base plate, the two side plates having second ends converging toward each other;

an arm made of a wire loop pivotally attached to the second end of each side plate;

a flexible cover having outer and inner layers;

the inner layer forming two pockets;

each pocket receiving a respective arm of the binder clip; and a connection between the two layers of material at a point within the loop of each arm to retain the arms in the pockets.

5. A method of making a money clip comprising:

a. obtaining a paper binder clip of a type having a spring clamp jaw and first and second arms made of wire loops pivotally attached to the clamp jaw for opening the jaw with the fingers of one hand;

b. forming a cover from first and second superimposed layers of flexible flat material connected together by a seam along the periphery thereof;

c. providing first and second slits in the second layer of the flat material;

d. inserting the binder clip arms in the respective slits; and e. connecting the two layers of cover material together at a point inside the loop of each arm.

* * * * *